United States Patent [19]

Miura

[11] 4,245,472

[45] Jan. 20, 1981

[54] SECONDARY AIR SUPPLY CONTROL APPARATUS FOR INTERNAL COMBUSTION ENGINE

[75] Inventor: Motohisa Miura, Toyota, Japan

[73] Assignee: Nippondenso Co., Ltd., Kariya, Japan

[21] Appl. No.: 41,932

[22] Filed: May 23, 1979

[30] Foreign Application Priority Data

May 26, 1978 [JP] Japan ..... 53-72086

[51] Int. Cl.[3] ..... F01N 3/10

[52] U.S. Cl. ..... 60/290; 60/289

[58] Field of Search ..... 60/289, 290

[56] References Cited

U.S. PATENT DOCUMENTS

| | | | |
|---|---|---|---|
| 3,433,242 | 3/1969 | Voorheis | 60/290 |
| 3,903,695 | 9/1975 | Nakada | 60/290 |
| 3,908,370 | 9/1975 | Kuroda | 60/290 |
| 3,934,413 | 1/1976 | Beiswenger | 60/289 |
| 3,950,943 | 4/1976 | Paddock | 60/290 |
| 4,007,756 | 2/1977 | Umino | 60/290 |
| 4,139,983 | 2/1979 | Shibata . | |

*Primary Examiner*—Douglas Hart

*Attorney, Agent, or Firm*—Cushman, Darby & Cushman

[57] ABSTRACT

A secondary air supply control apparatus for an internal combustion engine comprises an air pump for producing the secondary air flow, a secondary air supply passage leading to an exhaust system of the engine, a bypass passage leading to the atmosphere, and a valve element connected to a diaphragm. The diaphragm constitutes one wall of a pressure chamber which is supplied with a negative intake pressure prevailing in an intake system of the engine, so as to move the valve element to a position at which the secondary air flow is directed to the secondary air supply passage when the negative intake pressure is higher than a predetermined level. There is provided a control unit operable in response to the pressure of the secondary air flow supplied to the exhaust system to apply the atmospheric pressure to the pressure chamber, thereby moving the valve element to another position at which the secondary air flow is directed to the bypass passage when the pressure of the secondary air flow supplied to the exhaust system is increased beyond a level which imposes overload on the air pump.

9 Claims, 4 Drawing Figures

SECONDARY AIR SUPPLY CONTROL APPARATUS FOR INTERNAL COMBUSTION ENGINE

BACKGROUND OF THE INVENTION

1. Field of the Invention

The present invention relates to a secondary air supply control apparatus for controlling a secondary air flow supplied to an exhaust system of an internal combustion engine for purifying exhaust gas discharged from the engine.

2. Description of the Prior Art

Lately, as a measure for the purification of exhaust gas discharged from internal combustion engine, a secondary air supply apparatus has become increasingly employed which is destined to supply secondary air to the exhaust system from an air supply source constituted by an air pump. In this connection, the control of the secondary air supply is performed in dependence on the pressure prevalent in the intake or suction pipe (manifold) of the engine which is negative with reference to the atmospheric pressure and is in a proportional relationship to the revolution number of the engine in such manner that the secondary air supply to the engine exhaust system is permitted only when the negative intake or suction pressure in the engine intake pipe has attained a predetermined level and, if otherwise, the secondary air supply to the exhaust system is inhibited and bypassed to the atmosphere or back to the air pump. In the hitherto known control valve apparatus for effecting the secondary air supply control outlined above, there arises a problem that the air pump constituting the secondary air supply source is subjected to an overload when the pressure in the exhaust system of the engine is increased during the secondary air supply operation, resulting in a shortened use life of the air pump. As an attempt to evade such difficulty, it is known to provide a relief valve in combination with the secondary air supply control valve thereby to release a portion of the secondary air flow to the bypass conduit leading to the atmosphere or to the air pump when the pressure in the exhaust system increases beyond a predetermined level during the secondary air supply operation. However, with the provision of such relief valve, it has been impossible to reduce to a satisfactory manner the overload imposed on the air pump, because the relief valve tends to restrict the air flow passing therethrough to the bypass conduit due to the inherent operation behavior ascribable to the structure of the relief valve itself, as will be elucidated hereinafter.

SUMMARY OF THE INVENTION

An object of the invention is to provide a secondary air supply control apparatus for controlling a secondary air flow supplied to an exhaust system of an internal combustion engine which is immune to the drawbacks of the hitherto known control apparatus.

Another object of the invention is to provide a secondary air supply control apparatus which is capable of protecting an air pump constituting the secondary air supply source from overload conditions thereby to assure an extended use life of the air pump.

Still another object of the invention is to provide a secondary air supply control apparatus which is capable of diverting the secondary air flow to a bypass conduit when pressure in the engine exhaust system increases beyond a predetermined level.

Further object of the invention is to provide a secondary air supply control apparatus which is reliable in operation and can enjoy a long use life.

In view of above and other objects which will become apparent as description proceeds, there is proposed according to an aspect of the invention a secondary air supply control apparatus for an internal combustion engine which comprises an air pump for producing a secondary air flow, a secondary air passage connected to the air pump, a secondary air supply conduit leading to an exhaust system of the internal combustion engine, a bypass passage opened to the atmosphere, valve means for changing over the secondary air flow supplied from the air pump through the secondary air passage to direct either to the secondary air supply conduit leading to the exhaust system or to the bypass conduit in dependence on a negative intake pressure in an intake system of the engine, a diaphragm to which the valve means is connected, a pressure chamber defined on one side of the diaphragm and adapted to be supplied with a negative intake pressure prevailing in an intake system of the engine, the valve means being operable to move to a first position at which the secondary air flow is directed to the secondary air supply passage when the negative intake pressure supplied in the pressure chamber is higher than a first predetermined level, and control means responsive to a pressure of the secondary air flow supplied to the exhaust system for applying the atmospheric pressure to the pressure chamber thereby to move the valve means to a second position at which the secondary air flow is directed to the bypass passage when the pressure of the secondary air flow applied to the exhaust system is increased beyond a second predetermined pressure level.

Above and other objects, features and advantages of the invention will become more apparent by examining description of exemplary embodiments taken in conjunction with the accompanying drawings.

DETAILED DESCRIPTION OF THE PREFERRED EMBODIMENTS

Before entering into description of the exemplary embodiments of the invention, it will be helpful for having a better understanding of the invention to review in brief a hitherto known secondary air supply control valve apparatus.

Figure 1:
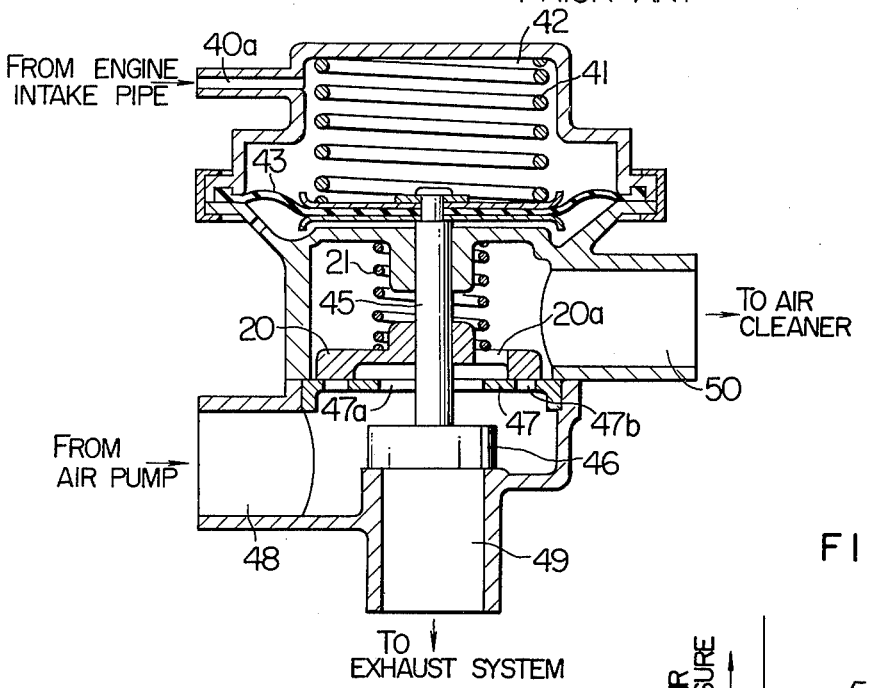
FIG. 1 PRIOR ART
FIG. 1 is a sectional view to illustrate a construction of a hitherto known secondary air supply control apparatus, FIG. 2 graphically illustrates performance characteristics of secondary air supply control apparatus according to embodiments of the invention in comparison with the hitherto known control apparatus shown in FIG. 1.

Referring to FIG. 1 which shows a typical example of the conventional secondary air supply control valve of a secondary air supply apparatus for an exhaust gas purifying system of an internal combustion engine, a negative pressure in an intake pipe of the internal combustion engine (not shown) is supplied through a pressure conduit 40*a* to a pressure chamber 42 having a movable bottom wall constituted by a diaphragm member 43 which is constantly urged downwardly as viewed in FIG. 1 by means of a compression spring 41. When the negative pressure supplied to the pressure chamber 42 overcomes a preset spring force of the compression spring 41, a valve element 46 connected to the diaphragm member 43 through a connecting rod 45 is caused to move upwardly as viewed in the figure thereby to close a valve opening 47*a* formed in a valve seat plate 47, as the result of which secondary air supplied from an air pump (not shown) is allowed to flow to an engine exhaust gas system (not shown) through secondary air supply passages 48 and 49. On the other hand, in the case where the negative pressure derived from the engine intake pipe is not sufficiently high to move upwardly the diaphragm member 43 and hence the valve element 46 against the force of the spring 41, secondary air is caused to flow to an air cleaner or to the atmosphere through the opening 47*a* of the valve seat 47 and the bypass passage 50.

In connection with the operation of the control valve apparatus outlined above, it has been heretofore known that the pressure in the secondary air supply passage or conduits 48 and 49 is increased as the pressure in the exhaust system is increased at the time when the secondary air supply is taking place with the valve opening 47*a* being closed. Consequently, the air pump is subjected to adverse influence particularly in respect of the durability thereof. As an attempt to evade such disadvantage, it is also known to provide a pressure relief valve element 20 to bypass a portion of the secondary air flow to the air cleaner. More specifically, the valve seat plate 47 is formed with a relief opening 47*b* around the valve opening 47*a* and the relief valve element having an opening 20*a* is disposed thereon to close usually the relief opening 47*b* under the resilient force of a compression spring 21, as is shown in FIG. 1. With such arrangement, when the pressure in the secondary air supply passage 48 during the secondary air supply operation is increased to overcome the preset force of the spring 21, the pressure relief valve element 20 is caused to move upwardly away from the valve seat plate 47 thereby to allow a part of the secondary air flow to be reliesed to the bypass conduit 50 through the relief opening 47*b*.

Figure 2:
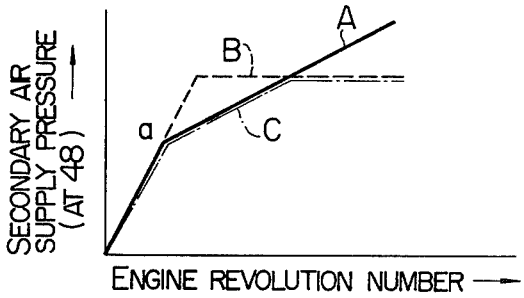

Experimental examinations conducted by the inventor of the present application on the relationship between the pressure in the secondary air supply passage 48 and the pressure in the exhaust system which is of course in a proportional relationship to the revolution number of the engine have however shown that the pressure in the secondary air conduit 48 still continues to increase even after the pressure relief valve 20 has been operated, as illustrated by a solid curve A shown in FIG. 2, which implies that an overload is still undesirably applied to the air pump. Such increase in the secondary air pressure after the opening or upward movement of the relief valve element 20 may be explained by the fact that an adequate relief air flow area can not be obtained even after the relief valve element 20 has been opened because the spring 21 tends to constantly urge the relief valve element 20 toward the valve seat plate 47 thereby to throttle the relief air flow. In FIG. 2, the pressure in the secondary air supply pressure 48 is taken along the ordinate, while the engine revolution number is taken along the abscissa. The relief valve 20 is apparently operated at an engine revolution number a.

In this manner, an adequate protection for the air pump can not be assured with the hitherto known structure of the secondary air supply control valve.

Figure 4:
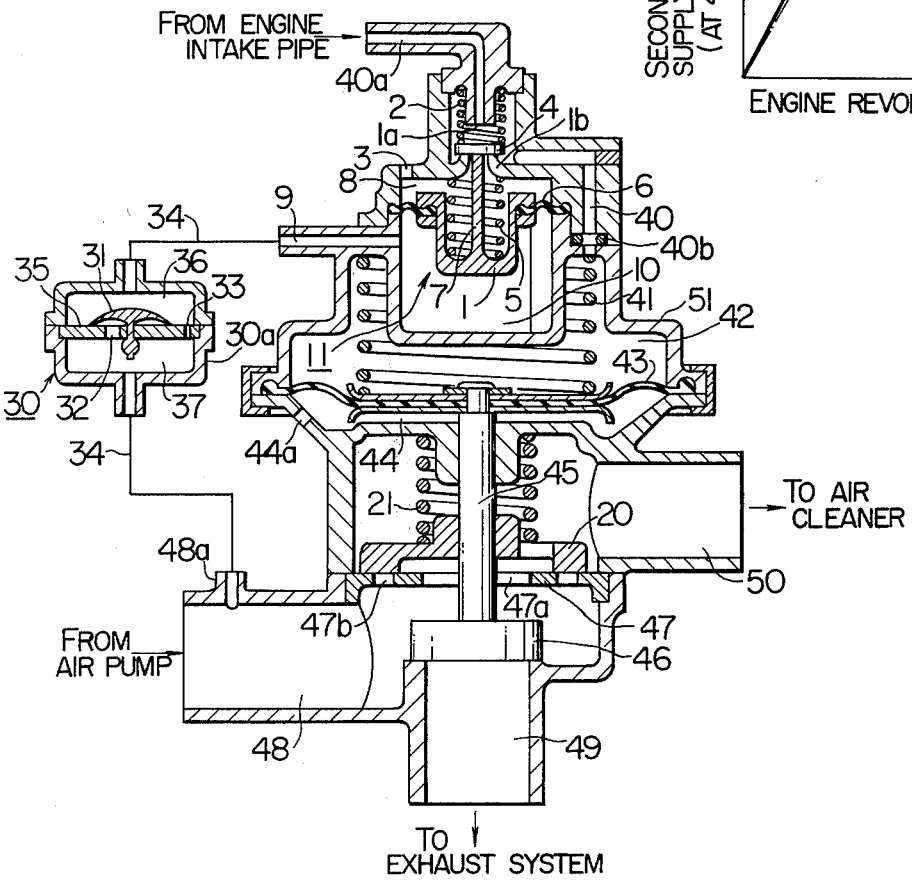
FIG. 4 is a sectional view showing a modified arrangement of the secondary air supply control apparatus according to another embodiment of the invention.
Figure 3:
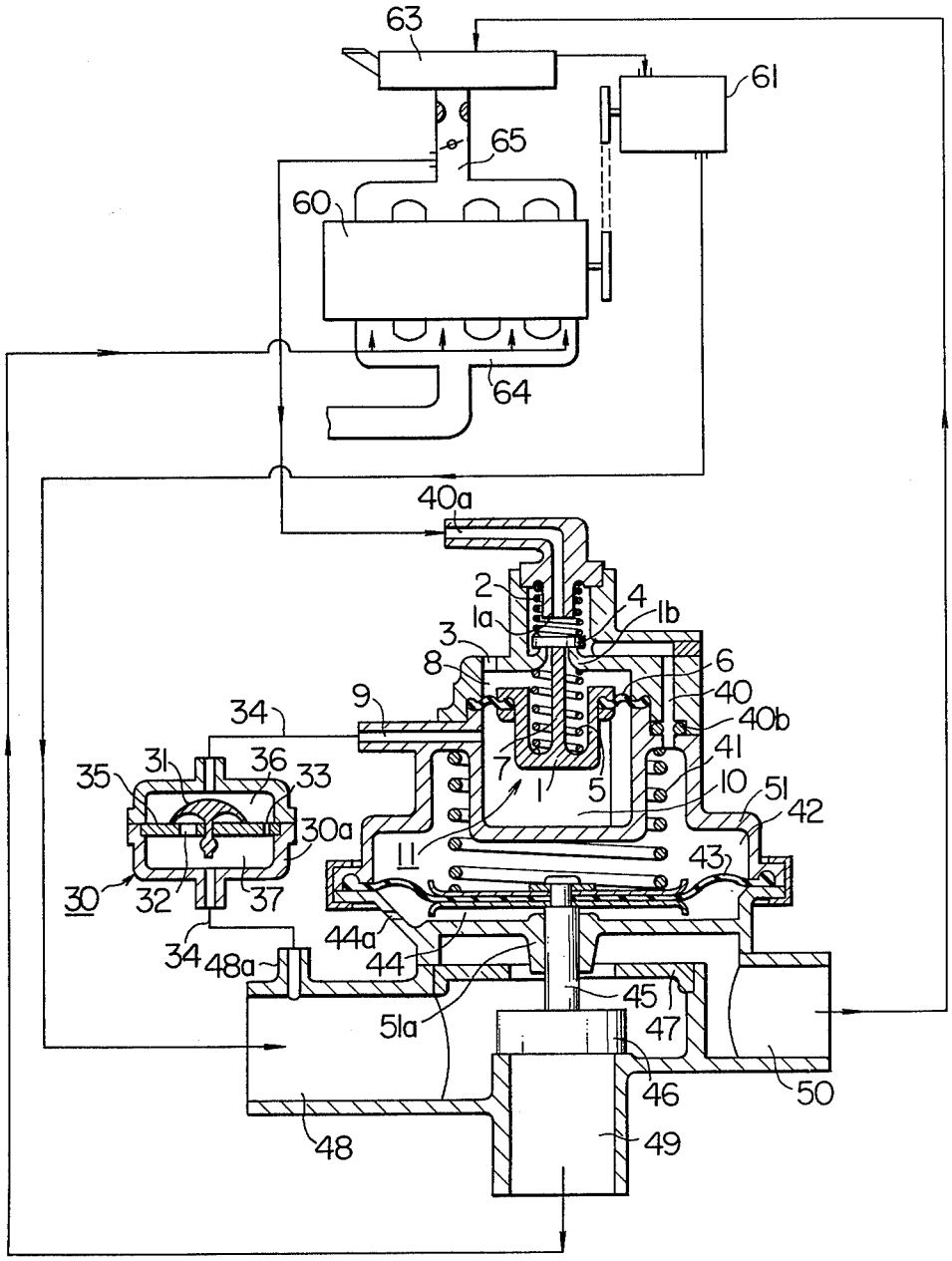
FIG. 3 is a sectional view showing an arrangement of the secondary air supply control apparatus according to an embodiment of the invention.

Now, the invention with which it is envisaged to eliminate the drawbacks of the prior art secondary air supply control valve apparatus will be described in detail by referring to FIGS. 3 and 4 showing exemplary embodiments of the invention.

Referring to FIG. 3, a secondary air flow discharged from an air pump 61 and fed through a secondary air pressure 48 is directed either to a secondary air supply conduit 49 leading to an exhaust system or manifold 64 of an internal combustion engine 60 or to a bypass conduit 50 connected to an air cleaner 63 in dependence on the position of a main valve element 46. In the illustrated position of the valve element 46, the secondary air flow is directed to the bypass conduit 50. The valve element 46 is connected through a connecting valve stem 45 to a diaphragm member 43 defining a pressure chamber 42 in cooperation with a housing 51, and is adapted to be moved upwardly and downwardly as viewed in FIG. 3 in response to the corresponding movement of the diaphragm member 43. The vertical movement of the valve stem 45 and the valve element 46 is guided by a sleeve 51*a* formed integrally with a bottom wall of the housing 51. A coil spring 41 is disposed within the pressure chamber 42 and constantly urges the diaphragm 43 downwardly as viewed in the drawing. A chamber 44 defined between the diaphragm 43 and the bottom wall of the housing 51 in opposition to the pressure chamber 42 is communicated to the atmosphere through an open port 44*a*. An intake pressure prevailing in an intake pipe 65 of the interval combustion engine 60 which is negative with reference to the atmospheric pressure is applied as a negative pressure signal to the pressure chamber 42 through a conduit 40*a* and a passage 40 in which an O-ring 40*b* is mounted.

On the way to the pressure chamber 42, a switching valve element 4 is disposed movably between a first valve seat 1*a* and a second valve seat 1*b* and is constantly urged toward the second valve seat 1*b* under the influence of a coil spring 2. When the switching or control valve element 4 rests on the second valve seat 1*b*, the pressure signal passage 40 is communicated to the conduit 40*a*, whereby the negative engine intake pressure is applied to the pressure chamber 42. On the other hand, when the control valve element 4 is caused to bear on the first valve seat 1*a* against the force of the spring 2 for the reason which will be made apparent hereinafter, the pressure signal passage 40 leading to the pressure chamber 42 is communicated to an atmospheric pressure chamber 8 having a port 3 opened to the atmosphere. A secondary air pressure chamber 10 is formed below the atmospheric pressure chamber 8 and is isolated from the latter by a diaphragm 6 which has a cup-like member 1 secured at a middle portion thereof. A center projection rod 7 extends upwardly from the bottom of the cup-like member 1 and is adapted to freely pass through the opening of the second valve seat 1*b* so that the top end of the upstanding projection 7 may bear against the lower surface of the switching valve element 4. A compression spring 5 is disposed around the upstanding projection 7 between a top wall of the atmospheric pressure chamber 8 and the bottom of the cup-like member 1 and urges resiliently the diaphragm 6 as well as the cup-like member 1 secured thereto downwardly as viewed in the drawing. The parts or members attached with reference numerals 1 to 10 constitutes a control unit which is generally denoted by a reference numeral 11.

The secondary air pressure chamber 10 is formed with an inlet port 9 which is connected to the secondary air pressure 48 at an outlet port 48*a* thereof through a conduit 34 in which a pressure delay valve generally designated by reference numeral 30 is disposed. The pressure delay valve 30 comprises a housing 30*a* having a partition wall 35 which defines an upper chamber 36 and a lower chamber 37 within the housing 30*a*. A check valve element 31 is movably disposed in the upper chamber 36 so as to open a valve aperture 32 formed in the partition wall 35 when the pressure in the secondary air pressure chamber 10 is lower than the pressure in the secondary air passage 48. If otherwise, the valve aperture 32 is closed by the check valve element 31. In addition to the valve aperture 32, a shunt passage 33 having a remarkably reduced diameter as compared with that of the valve aperture 32 is formed in the partition wall 35. Thus, when the pressure in the secondary air pressure chamber 10 is higher than the one prevailing in the passage 48 and thus the valve aperture 32 is closed by the check valve element 31, the pressure within the secondary air pressure chamber 10 is allowed to flow only progressively to the passage 48 through the restricted shunt passage 33.

Now, description will be made on operations of the secondary air supply control apparatus of the structure described above.

So long as the internal combustion engine 60 is operated in a normal operating condition after having been started, the negative intake pressure supplied from the engine intake pipe 65 to the pressure chamber 42 through the conduit 40*a* and the pressure signal passage 40 causes the diaphragm 43 to be moved upwardly as viewed in the drawing against the preset force of the spring 41, as the result of which the valve element 46 connected to the diaphragm 43 is also moved upwardly to close the bypass conduit 50 while opening the secondary air supply conduit 49. Consequently, the secondary air flow discharged from the air pump 61 is allowed to be supplied to the engine exhaust system 64 through the supply conduit 49, whereby unburned components such as CO and HC undergo combustion or oxidation to purify the exhaust gas.

Now, assuming that the revolution number of the engine 60 is increased, involving a correspondingly increased exhaust gas pressure in the exhaust gas pipe 64 and resulting in that the pressure in the secondary air passage 48 becomes higher than the normal or rated pressure of the air pump 61 (e.g. a pressure level in the range of 0.275 to 0.5 $Kg/cm^2$) at which the air pump can be operated safely without being subjected to overload condition which may incur deterioration in the durability of the air pump 61, then the control unit 11 provided according to the teaching of the invention becomes operative to prevent the pressure in the secondary air passage 48 from being increased beyond a predetermined level, thereby to protect the air pump 61 from the overload condition. In more detail, by virtue of such arrangement that the pressure in the secondary air passage 48 is introduced to the secondary air pressure chamber 10 through the pressure conduit 34 having the pressure delay unit 30 incorporated therein, increase of the secondary air pressure in the chamber 10 beyond the preset combined force of the springs 2 and 5 (e.g. 0.6 $Kg/cm^2$) will causes the diaphragm 6 to be moved upwardly as viewed in FIG. 3 together with the cup-like member 1, as the result of which the upstanding projection 7 causes the switching valve element 4 to be moved upwardly. Consequently, the switching valve element 4 bears on the first valve seat 1*a* to close the conduit 40*a* on one hand and allows the pressure chamber 42 to be communicated to the atmospheric pressure chamber 8 through the passage 40 and the now opened aperture of the second valve seat 1*b* on the other hand, resulting in that the atmospheric pressure is fed to the pressure chamber 42 from the atmospheric pressure chamber 8 through the passage 42. As the consequence, the negative pressure prevailing in the pressure chamber 42 is lowered (i.e. approaches to the atmospheric pressure), whereby the diaphragm 43 is urged downwardly as viewed in FIG. 3 under the force of the spring 41. Thus, the valve element 46 connected to the diaphragm 43 through the shaft 45 is also moved downwardly, thereby to open the bypass passage 50. The result is that the secondary air supplied from the air pump 61 is caused to flow to the air cleaner 63 through the bypass conduit 50, thereby to decrease the pressure in the secondary air flow passage 48 to the normal or rated discharge pressure level of the air pump 61 (e.g. pressure level in the range of 0.275 to 0.5 $Kg/cm^2$).

When the pressure in the secondary air flow passage 48 has been reset to the normal level in the manner described above, the pressure in the secondary air pressure chamber 10 is progressively relieved into secondary air flow passage 48 through the restricted shunt passage 33 of the pressure delay valve unit 30. Thus, after lapse of a predetermined time, the switching valve element 4 will have been moved downwardly under the preset force of the spring 2 to the position to open again the conduit 40*a*, whereby the engine intake pressure is again introduced into the pressure chamber 42. Concurrently, the valve element 46 is progressively moved upwardly to close the bypass passage 50 while opening the secondary air supply conduit 49 to allow again secondary air to be supplied to the engine exhaust system.

As will be appreciated from the foregoing description, the pressure in the secondary air flow passage 48 is prevented from increasing beyond a preset pressure level which corresponds to the preselected combined force of the springs 2 and 5 (e.g. 0.6 $Kg/cm^2$). In this manner, the secondary air supply control apparatus exhibits the performance characteristic such as indicated by a broken curve B in FIG. 2.

Next, it is assumed that the internal combustion engine 60 is operated in a high or heavy load state. Under the condition, the negative intake pressure supplied to the pressure chamber 42 through the conduit 40*a* and the passage 40 will be correspondingly decreased approximately to the atmospheric pressure, resulting in that the preset force of the spring 41 overcomes the negative pressure in the chamber 42 to cause the diaphragm 43 to be moved downwardly. Consequently, the secondary air supply conduit 49 is closed by the valve element 46 while the bypass passage 50 is opened. In this manner, in the heavy load state of the engine 60 in which a large quantity of exhaust gas flow takes place at a high temperature in the exhaust system, the secondary air supply to the latter is inhibited to assure effective protection of catalyst, sensors or the like elements (not shown) disposed in the engine exhaust system. It should be mentioned that the secondary air supply control apparatus is shown in FIG. 3 in the position corresponding to the heavy load operation state of the engine 60.

The secondary air supply control apparatus described above in advantageous over the prior art control valve apparatus such as shown in FIG. 1 in that improved switching operation of the valve element 46 can be attained with air leakage between the valve element 46 and the respective valve seats being positively inhibited because the connecting shaft 45 can be implemented in a very short length due to unnecessity of providing a pressure relief valve such as the one 20 shown in FIG. 1. Further, by virtue of the provision of the pressure delay valve 30, the valve element 46 is protected from being caused to bear instantly and rapidly against the valve seat of the secondary air supply conduit 49 even when the pressure in the secondary air flow passage 48 is rapidly decreased due to the opening of the bypass passage 50, whereby the undesirable noise generation as well as unwanted mechanical stress or possible injuries to the valve element 46, spring 41 and the valve seat of the secondary air supply conduit 49 due to the operation of the valve element 46 can be advantageously suppressed to a significant degree.

Although the pressure delay valve unit 30 is assumed to be provided separately from the body of the control valves in the foregoing description, it will be appreciated that the unit 30 may be constructed integrally with either one or both of the pressure port 9 of the secondary air pressure chamber 10 and the outlet port 48*a* of the secondary air flow passage 48.

In this conjunction, it should be mentioned that the pressure delay valve unit 30 may be eliminated provided that the valve element 46, the spring 41 and the valve seat provided by the open end of the secondary air supply passage 49 are imparted with sufficiently great mechanical strength or if it is desired to move the valve element 46 with a high sensitivity for switching the secondary air flow to the air supply conduit 49 from the bypass conduit 50.

Further, when the upstanding projection 7 is formed integrally also with the valve element 4, one of the springs 2 and 5 can be omitted.

Furthermore, it is possible to form in the pressure signal passage 40 a restriction (not shown) which serves to decelerate the movement of the valve element 46 when the secondary air flow is switched to the bypass conduit 50 from the supply conduit 49.

FIG. 4 shows another embodiment of the invention in which the relief valve such as shown in FIG. 1 is combined with the secondary air supply control apparatus described above according to the invention. In this figure, same reference symbols are used for identifying the same components as those shown in FIGS. 1 and 3. Since it is believed that the structure and the operation of the apparatus shown in FIG. 4 can be readily understood from the foregoing elucidation, further detailed description will be unnecessary. However, it should be mentioned that the relief valve 20 is located between the pressure chamber 42 and the valve element 46 with a valve seat common to both valves being interposed therebetween. The relief valve 20 is caused to bear on the valve seat 47 under a force of the spring 21 which is selected smaller than that of the spring 41 of the pressure chamber so that a portion of the secondary air flow may be directed to the bypass conduit 50 in proportional dependence on increase in pressure of the secondary air flow in the pressure range below the pressure level which is determined by the spring 41. Accordingly, the control apparatus shown in FIG. 4 will exhibit the performance characteristic indicated by a dotted broken curve C in FIG. 2.

In accordance with another embodiment, the control unit 11 including the diaphragm 6 and so forth may be replaced by an electromagnetic or solenoid valve which is provided in a pressure for applying atmospheric pressure to the pressure chamber 42 and which is combined with a pressure sensor switch provided in the secondary air flow passage 48 in such a manner that the solenoid valve is opened to feed the atmospheric pressure to the pressure chamber in response to the electric signal produced by the pressure sensor switch when the pressure in the secondary air flow passage 48 has attained a predetermined level (e.g. 0.6 $Kg/cm^2$).

As will be appreciated from the foregoing description, the secondary air supply control apparatus according to the invention can assure a satisfactory protection for the air pump 61 by preventing the pressure in the secondary air flow passage from increasing beyond a predetermined pressure level.

Although the invention has been described in conjunction with the exemplary embodiments shown in the accompanying drawings, it will be appreciated that the invention is never restricted to them but many modifications and variations will readily occur to those skilled in the art without departing from the scope and spirit of the invention.

I claim:

1. A secondary air supply control apparatus for controlling secondary air flow supplied to an exhaust system of an internal combustion engine for purification of exhaust gas discharged therefrom comprising:

an air pump for producing the secondary air flow, a secondary air supply passage leading to said exhaust system, a bypass passage leading to the atmosphere, valve means for changing over said secondary air flow to direct either to said secondary air supply passage or said bypass passage, a diaphragm to which said valve means is connected, a pressure chamber defined on one side of said diaphragm and adapted to be supplied with a negative intake pressure prevailing in an intake system of said engine, said valve means being operable to move to a first position at which said secondary air flow is directed to said secondary air supply passage when said negative intake pressure supplied in said pressure chamber is higher than a first predetermined level, and control means responsive to a pressure of said secondary air flow supplied to said exhaust system for applying the atmospheric pressure to said pressure chamber thereby to move said valve means to a second position at which said secondary air flow is directed to said bypass passage when said pressure of said secondary air flow supplied to said exhaust system is increased beyond a second predetermined pressure level.

2. A secondary air supply control apparatus as set forth in claim 1, wherein said first predetermined level is preset by a spring disposed in said pressure chamber and adapted to resiliently urge said diaphragm in a direction opposite to the direction in which said diaphragm is moved by said negative intake pressure supplied to said pressure chamber.

3. A secondary air supply control apparatus as set forth in claim 2, wherein said control means includes a secondary air pressure chamber which is applied with the pressure of said secondary air flow, an atmospheric pressure chamber isolated from said secondary air pressure chamber by a second interposed diaphragm, and a control valve element operatively connected to said second diaphragm and adapted to take two positions at one of which said pressure chamber is supplied with said negative intake pressure, while at the other position of said control valve element said pressure chamber is communicated to said atmospheric pressure chamber.

4. A secondary air supply control apparatus as set forth in claim 3, wherein said second predetermined pressure level is preset by a second spring exerting a spring force to urge said second diaphragm toward said secondary air pressure chamber against the pressure therein.

5. A secondary air supply control apparatus as set forth in claim 4, wherein said second diaphragm is provided with an actuator rod member adapted to move said control valve element to said other position against said second spring when the pressure in said secondary air pressure chamber increases beyond said second predetermined pressure level.

6. A secondary air supply control apparatus as set forth in claim 3, wherein said secondary air pressure chamber is communicated with said secondary air flow through a check valve which is closed only when the pressure in said secondary air pressure chamber is higher than that of said secondary air flow, said check valve being shunted by a restricted passage to serve as a delay unit for retarding movement of said valve means toward said first position.

7. A secondary air supply control apparatus as set forth in claim 3, wherein a restriction is formed in the passage for introducing said negative intake pressure to said pressure chamber thereby to retard the movement of said valve means toward said second position.

8. A secondary air supply control apparatus as set forth in claim 2, wherein a relief valve is provided in parallel with said valve means and adapted to direct a portion of said secondary air flow to said bypass passage in proportional dependence on increase in the pressure of said secondary air flow in a pressure range below said second predetermined pressure level.

9. A secondary air supply control apparatus as set forth in claim 8, wherein said relief valve is disposed between said pressure chamber and said valve means and positioned in opposition to said valve means with a valve seat interposed in common to both of said relief valve and said valve means, said valve seat being provided with a relief opening for said relief valve in addition to an opening for said valve means, and said relief valve is urged to bear on said valve seat under a force of a spring which is smaller than that of said spring disposed in said pressure chamber.

* * * * *